United States Patent [19]

Fredrickson et al.

[11] Patent Number: 4,495,715

[45] Date of Patent: Jan. 29, 1985

[54] FOOT APPLIANCE

[76] Inventors: James C. Fredrickson, 629 Tollis Pkwy., Broadview Hts., Ohio 44147; Patricia J. Noga, 4775 Columbia Rd., North Olmsted, Ohio 44070; Frank M. Strasek, 21851 Center Ridge, Rocky River, Ohio 44116

[21] Appl. No.: 263,694

[22] Filed: May 14, 1981

[51] Int. Cl.[3] ..... A43B 3/00; A43B 3/18; A43B 3/20

[52] U.S. Cl. ..... 36/113; 36/7.1 R; 36/7.2; 36/114; 2/2; 128/153

[58] Field of Search ..... 2/22, 2, DIG. 6, 239, 2/16, 18, 161 R, 161 A; 128/80 R, 81 R, 149, 153; 36/7.2, 72 R, 77 R, 11.5, 113, 114, 7.1 R, 83, 93, 96, 88; 272/76

[56] References Cited

U.S. PATENT DOCUMENTS

| | | | |
|---|---|---|---|
| 202,209 | 4/1878 | Woodhull | 36/7.2 |
| 249,668 | 11/1881 | Piles | 36/7.2 |
| 1,944,664 | 1/1934 | Maxcy | 36/11.5 |
| 2,258,322 | 10/1941 | Frolich | 36/7.7 |
| 2,751,691 | 6/1956 | Clark | 36/77 R |
| 3,063,167 | 11/1962 | Scholl | 36/11.5 |
| 3,325,919 | 6/1967 | Robinson | 36/93 |
| 3,487,830 | 1/1970 | Pruett | 2/239 |
| 4,277,897 | 7/1981 | O'Connell | 36/113 |
| 4,287,610 | 10/1981 | Rhee | 2/161 A |

FOREIGN PATENT DOCUMENTS

| | | | |
|---|---|---|---|
| 2245807 | 4/1973 | Fed. Rep. of Germany | 36/7.4 |

*Primary Examiner*—Henry S. Jaudon
*Assistant Examiner*—Steven N. Meyers
*Attorney, Agent, or Firm*—Fay & Sharpe

[57] ABSTRACT

A foot appliance for use in the martial arts. The appliance consists of a generally cup-shaped member which is adapted to be placed over the toes of the foot in a manner so as to substantially cover the toes and provide support therefor. The cup-shaped member is retained in place by means of a strap element which extends behind the heel of the foot. Optionally, there is provided an additional strap element which extends from the arch of the foot to the instep thereof. The appliance is adapted to provide protection for the toes when a participant is engaged in the martial arts.

3 Claims, 4 Drawing Figures

FIG. 1
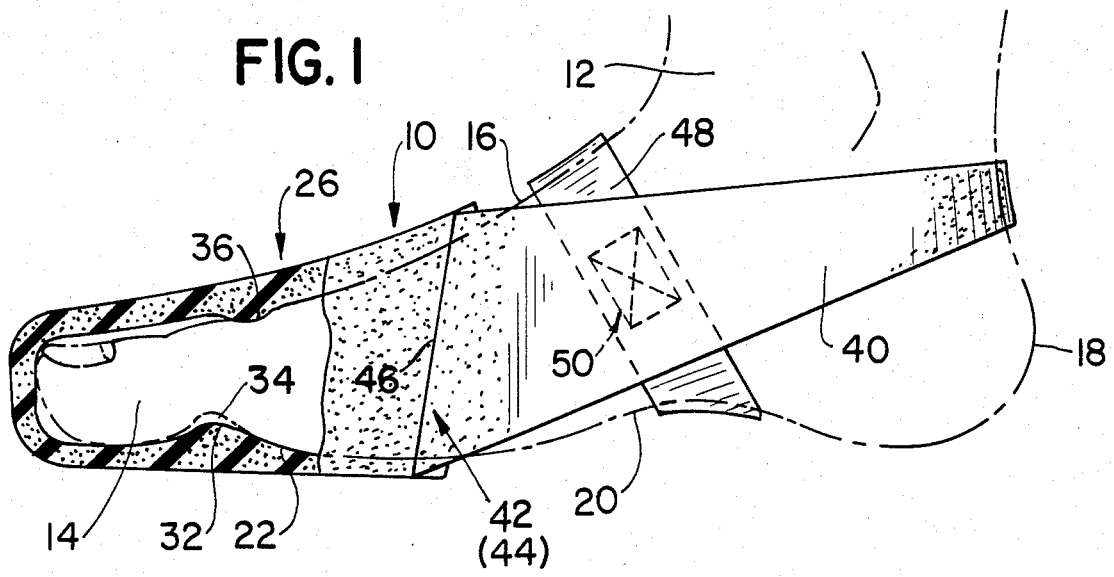
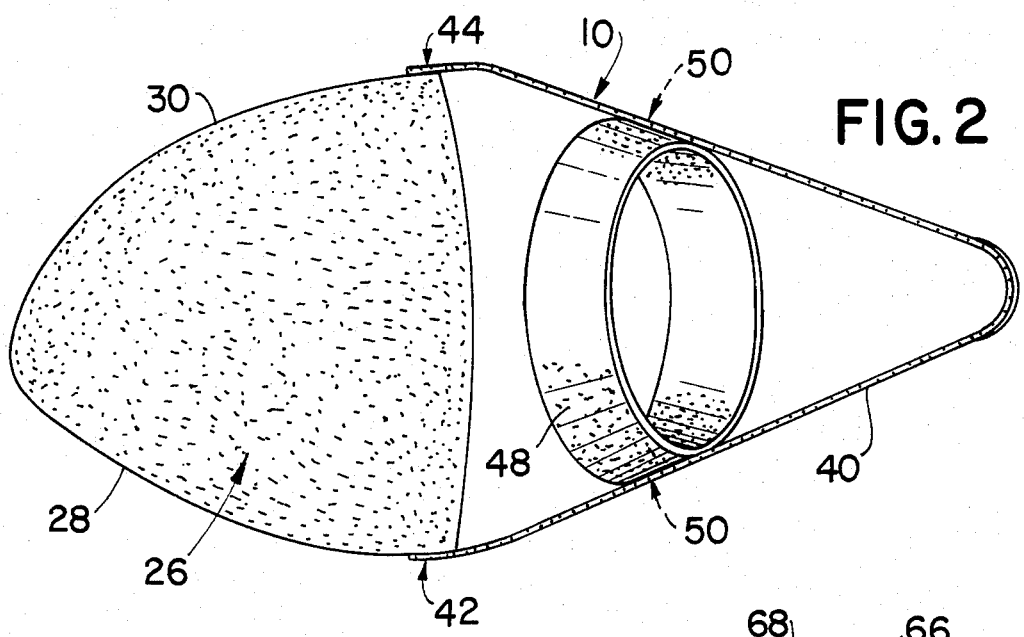
FIG. 2
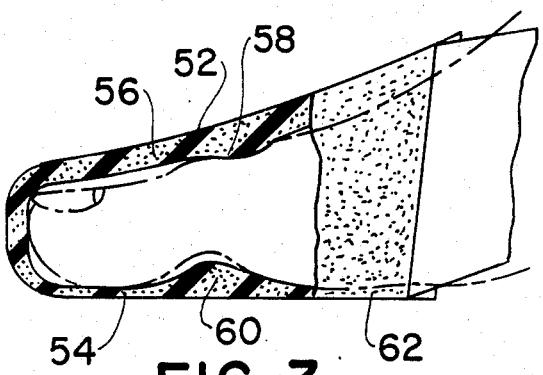
FIG. 3
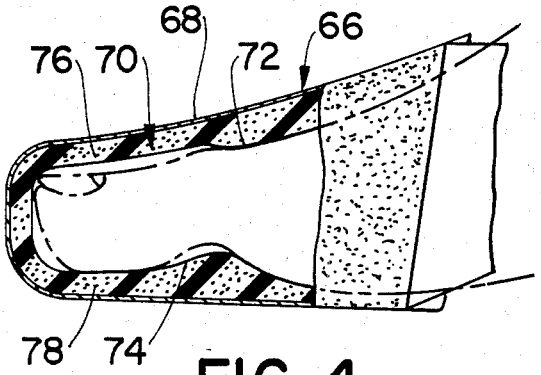
FIG. 4

FOOT APPLIANCE

BACKGROUND OF THE INVENTION

This invention is directed to a foot appliance for use in the martial arts such as karate and the like.

In martial arts such as karate, a number of movements of the body are employed including the kick, the punch, the block, and the counter. Kicks are more powerful than punches but slower and harder to control. They can leave the kicker unbalanced and defenseless. In the martial arts such as karate, the main parts of the foot used for kicking are the ball of the foot, the instep, the side of the foot, and the heel.

Since participants in the martial arts do not ordinarily provide any covering for the feet, the toes of the foot are exposed and are susceptible to injury. While it is not the intent of the kicker to strike his opponent with the toes, there are instances in which the toes do, in fact, come in contact with an opponent. Such instances occur when, for example, the kick is misdirected or there is a change in position of the opponent.

As a consequence, the striking of an opponent with the foot in a manner so as to cause the toes to come in contact with an opponent can cause pain and injury to the participant.

This invention is in the nature of a foot appliance for use in the martial arts for the purpose of protecting the toes of the foot and providing support therefor.

BRIEF DESCRIPTION OF THE INVENTION

Briefly described, applicant's invention comprises a foot appliance for use in the martial arts.

Applicant's appliance comprises a generally cup-shaped member which is adapted to be placed over the toes of the foot in a manner so as to substantially cover the toes of the foot and provide support therefor. The cup-shaped member, in the preferred embodiment, is fabricated from a soft, felt-like material which is adapted to be placed in close proximity to the toes of the foot. A first strap extends from the cup-shaped member around the heel in order to provide for retention of the cup-shaped member. A second strap extends around the instep and arch of the foot in order to provide for added retention.

In alternate embodiments of the invention, the cup-shaped member is defined by a relatively hard lined shell-like structure fabricated from plastic or the like.

BRIEF DESCRIPTION OF THE DRAWINGS

The preferred embodiment of applicant's invention will now be described with reference to the drawings in which:

FIG. 1 is a side view, partly in elevation and partly in section, showing applicant's foot appliance in place on a human foot;

FIG. 2 is a top elevational view, partly in section, showing applicant's foot appliance;

FIG. 3 is a side view, partly in elevation and partly in section, showing a modified form of applicant's foot appliance; and, FIG. 4 is a side view partly in elevation and partly in section showing a still further modified embodiment of applicant's foot appliance.

DESCRIPTION OF THE PREFERRED EMBODIMENT

The preferred embodiment of the invention will now be described with reference initially to FIG. 1. Applicant's foot appliance is generally designated 10 and is shown in place on a human foot 12. The foot 12 includes a plurality of toes 14, an instep 16, a heel 18 and an arch 20. The ball of the foot is generally designated 22 in FIG. 1.

Foot appliance 10 is defined by a generally cup-shaped member 26 which, in the preferred embodiment, is fabricated from a generally felt-like material. As shown in FIG. 1, member 26 is generally U-shaped or cup-shaped in side elevation and is adapted to substantially cover the toes 14 while, at the same time, providing support for the toes by extending over the ball 22 of the foot, and at least partially over the instep 16.

In the top elevational view of FIG. 2, it will be seen that the member 26 includes an inner sidewall 28 which is adapted to be in close proximity to the large toe of the foot and an outer sidewall 30 which is adapted to extend along the smaller toes of the foot. The general configuration of member 26 is such that it is closely received about the toes and is shaped so as to conform therewith.

The exterior surface of member 26 is generally smooth in configuration. The internal surface of member 26 includes a bottom ridge 32 (FIG. 1) which is adapted to extend into the space 34 defined at the intersection of the toes with the body of the foot. There is also provided a top ridge 36 (FIG. 1) which is adapted to engage or be placed in close proximity to the upper surface of the toes near the point where the toes are connected to the main body of the foot. The purpose and function of the ridges 32, 36 is to provide support for the toes in the event that the end of the foot (which includes the toes) should strike an opponent in the martial arts.

Member 26 is held in place on the foot by means of a first strap 40. In the preferred embodiment, strap 40 is fabricated from an elastic material made up of a single length of material secured at either end to the member 26 at locations generally designated 42, 44. In the preferred embodiment, strap 40 is stitched to the member 26 at each of locations 42, 44 along a line 46. The strap 40 functions to retain member 26 in place when positioned just slightly above the heel 18 as shown in FIG. 1. When in place, strap 40, in the preferred embodiment, will be slightly extended or slightly stretched so as to pull the member 26 securely about the toes 14.

Providing further support for the member 26 is a second strap 48. As shown in FIGS. 1 and 2, strap 48 extends in a generally transverse direction as compared to strap 40. Strap 48 is stitched to strap 40 at locations generally designated 50 in FIGS. 1 and 2. Strap 48 extends around instep 16 and under the arch 20 in a snug or close relationship to the foot. In the preferred embodiment of this invention, strap 48 is fabricated from Velcro material defining a single length of strap which has free ends (not shown) extending around the instep 16. The strap 48 is tightened as by overlapping the free ends around the instep 16 and securing the free ends together by bringing them into contact in the manner best shown in FIG. 2.

Applicant's foot appliance is shown fully installed in FIG. 1. Member 26 of FIG. 1 is in place substantially covering the toes of the foot and providing support therefor through cooperation of the straps 40, 48.

MODIFICATIONS OF THE INVENTION

Modifications of the invention are contemplated and should be considered within the spirit thereof.

In FIG. 3, a modified cup-shaped member 52 is shown. As with the cup-shaped member 26 of FIG. 1, member 52 of FIG. 3 is defined by a relatively soft felt-like material. It will be seen that in the modified form of the invention of FIG. 3, the sole portion 54 of the member 52 is relatively thin as compared to the thickness of the top wall 56. In the preferred embodiment of FIG. 1, the wall thickness of the member 26 is substantially uniform with the exception, of course, of the wall in the vicinity of the ridges 32, 36. Ridges 58, 60 are provided in the modified embodiment of FIG. 3. However, the sole portion 54 and the end portion 62 of the modified embodiment of FIG. 3 are relatively thin as compared to the top wall 56. In all other respects, the modified form of the invention as shown in FIG. 3 is similar to that as shown in FIG. 1. In the interest of clarity, the remaining portions of the appliance including the straps have been omitted from FIG. 3.

A still further modified form of the invention is shown in FIG. 4. The cup-shaped member 66 of FIG. 4 is defined by a relatively thin shell 68 which may be fabricated from plastic or other similar material. The internal wall of shell 68 is provided with a lining 70 which is configured very similar to the member 26 of FIG. 1. That is to say, the lining 70 of FIG. 4 includes ridges 72, 74 and relatively thick top and bottom walls 76, 78.

Other modifications of the invention are contemplated and should be considered within the spirit thereof.

While in the embodiments shown in FIGS. 1, 3 and 4 the cup-shaped member is of a depth so as to substantially cover the toes, extend over the ball of the foot and at least partially cover the instep, it should be appreciated that cup-shaped members having a longer or shorter extension relative to the toes, the ball of the foot and the instep are possible. The cup-shaped member may be so shallow as to barely cover the toes or, alternately, may be of sufficient depth that it substantially covers the instep 16 while extending significantly into the arch 20.

While in the preferred embodiment the member 26 is fabricated from felt-like material of varying thicknesses which may or may not include an outer shell, it should be appreciated that such member may be fabricated entirely from injection molded self-skinning foam or other foam products. Alternately, structures are possible whereby the cup-shaped member includes a partial shell which may extend either over the upper part of the toe or under the bottom part of the toe in conjunction with foam, felt or cloth material.

With respect to the straps, it should be appreciated that while in the preferred embodiment elastic and Velcro materials are used, other strap materials may be used including rigid materials.

What is claimed is:

1. A foot appliance for use in the martial arts comprising in combination:

a generally cup-shaped member of soft flexible material adapted to be closely placed over the toes of the foot, said member covering the toes of the foot for providing support therefor and having portions in contact with the foot extending toward the foot ball and instep areas;

ridges disposed on the interior surface of said cup-shaped member, one of said ridges adapted to engage the underside of the foot and another of said ridges adapted to engage the upper surface of the foot, the engagement of said ridges occurring at generally the areas of interconnection of the toes with the foot; and, a first strap element which is adapted to closely surround the heel of the foot to retain said cup-shaped member in close relation to the toes.

2. The invention of claim 1 wherein said first strap element is of elastic material.

3. The invention of claim 2 including an adjustable second strap element attached to said first strap element and positioned to extend under the arch and over the instep of a foot.

* * * * *